US005634264A

United States Patent [19]

Dear et al.

[11] Patent Number: 5,634,264

[45] Date of Patent: Jun. 3, 1997

[54] RIVETING APPARATUS

[75] Inventors: Aiden R. Dear, Hitchin; Keith Denham; Angraj K. Seewraj, both of Welwyn Garden City, all of England

[73] Assignee: Avdel Textron Limited, Welwyn Garden City, England

[21] Appl. No.: 618,717

[22] Filed: Mar. 20, 1996

[30] Foreign Application Priority Data

Mar. 24, 1995 [GB] United Kingdom ..... 9505994

[51] Int. Cl.[6] ..... B21J 15/34

[52] U.S. Cl. ..... 29/812.5; 72/391.6

[58] Field of Search ..... 72/391.6; 29/812.5

[56] References Cited

U.S. PATENT DOCUMENTS

| | | | |
|---|---|---|---|
| 3,717,023 | 2/1973 | Prosser et al. . | |
| 3,828,603 | 8/1974 | Sheffield et al. | 72/391.6 |
| 4,059,981 | 11/1977 | Holloway | 29/812.5 |
| 4,220,033 | 9/1980 | Powderley | 72/391.6 |
| 4,368,838 | 1/1983 | Sheffield et al. . | |
| 5,035,129 | 7/1991 | Denham et al. | 72/391.6 |

FOREIGN PATENT DOCUMENTS 1183049 3/1970 United Kingdom .

*Primary Examiner*—David Jones

*Attorney, Agent, or Firm*—Oblon, Spivak, McClelland, Maier & Neustadt, P.C.

[57] ABSTRACT

A riveting apparatus which includes an elongated mandrel, a mandrel gripping mechanism, a mechanism for feeding rivets forwardly along the mandrel, and an abutment provided by a plurality of members, and a control system including an actuation device such that, upon actuation by an operator of the actuation device, the control system controls the riveting apparatus so that the rivet feeding mechanism is activated and deactivated, the abutment members are closed or opened, and the mandrel gripping mechanism is activated or deactivated, with a time delay between each step, to enable rapid removal and replacement of the mandrel.

17 Claims, 9 Drawing Sheets

RIVETING APPARATUS

This invention relates to riveting apparatus of the type whereby a plurality of tubular blind rivets may be set in succession by drawing through the bore of each one of the rivets in turn an enlarged head of a riveting mandrel while the rivet is supported by an abutment.

Such rivets are well-known and widely available under the Registered Trademarks CHOBERT and BRIV.

More particularly the invention relates to riveting apparatus of the type in which an elongated mandrel, having an enlarged head at one end and loaded with a plurality of the tubular rivets forming a column of rivets on the mandrel, is gripped by gripping means at or near the end remote from the head, and reciprocated relative to an abutment by relative reciprocation between the gripping means and the abutment, the rivets in the column being fed forwardly along the mandrel so that the leading rivet nearest the mandrel head is positioned between the mandrel head and the abutment and can then be set by moving the mandrel rearwardly relative to the abutment so as to draw the head of the mandrel through the bore of the rivet while the rivet is supported by the abutment. Such apparatus is hereinafter referred to as "riveting apparatus of the type defined".

The abutment is usually provided by a nosepiece comprising jaws between which the mandrel extends, and which are separable to allow rivets which are fed forwardly along the mandrel to pass between them, the jaws being spring urged to close together behind a fed rivet which has passed forwardly of the jaws, and to resist rearward movement of the fed rivet. An example of such riveting apparatus is described in GB 1 183 049.

Such riveting apparatus is well-known and much used in the mechanical assembly industry, and is widely available under the designations AVDEL 717 Series, AVDEL 727 Series and AVDEL 753 Series (AVDEL is a Registered Trade Mark).

As mentioned a column of rivets is provided on the mandrel. Typically the column comprises about fifty rivets, depending on the length of the rivet. When all of the rivets on the mandrel have been set, use of the apparatus must be temporarily stopped, while the mandrel is removed from the apparatus, reloaded with a new column of rivets, and then re-inserted in the apparatus.

Such repeated interruption of the use of the apparatus is very inconvenient under modern production-line conditions, where all stages of the production manufacturing process must be carried out as near continuously as possible with the minimum of interruption.

One solution to this problem which has been used with success in certain circumstances is to continuously reload the mandrel with rivets by repeatedly feeding rivets in succession onto the tail end of the mandrel (i.e. the end remote from the mandrel head). See, for example GB 1 287 572 and GB 1 397 543. However, the extra mechanism and rivet-feeding means which this involves makes the resulting apparatus larger, heavier and less mobile. This arrangement is undesirable for use with a hand-held rivet setting apparatus.

SUMMARY OF THE INVENTION

The present invention, in one of its aspects, aims to facilitate and speed up the removal of an empty mandrel from, and the insertion of a reloaded mandrel into, a riveting apparatus of the type defined. Its application will be particularly useful in relation to hand-held rivet setting apparatus, but of course it could also be applied to machine-mounted rivet setting apparatus.

In one of its aspects, the invention provides a riveting apparatus of the type defined, including means for feeding rivets forwardly along the mandrel, and an abutment provided by a plurality of members movable between a closed position in which they provide an abutment to support a rivet as aforesaid and an open position in which they allow the free passage of rivets between them, and also including the provision of a control system operatively connected to the appropriate elements of the apparatus for controlling their operation respectively, the control system including an actuation device, such that, upon actuation by an operator of the actuation device when the riveting apparatus has a mandrel therein, the control system controls the riveting apparatus so that the following steps occur in sequence:

1. the rivet-feeding means is de-activated;
2. the abutment members are opened;
3. the mandrel gripping means is de-activated;

so that the mandrel and any rivets remaining thereon can readily be removed from the tool.

In another of its aspects, the invention provides a riveting apparatus of the type defined, including means for feeding rivets forwardly along the mandrel, and an abutment provided by a plurality of members movable between a closed position in which they provide an abutment to support a rivet as aforesaid and an open position in which they allow the free passage of rivets between them, and also including the provision of a control system operatively connected to the appropriate elements of the apparatus for controlling their operation respectively, the control system including an actuation device, such that, after a mandrel loaded with rivets has been inserted into the apparatus, upon actuation by an operator of the actuation device the control system controls the riveting apparatus so that the following steps occur in sequence:

1. the mandrel-gripping means is activated;
2. the rivet-feeding means is activated;
3. the abutment members are closed;

thereby making the apparatus ready for further setting of rivets.

BRIEF DESCRIPTION OF THE DRAWINGS

A specific embodiment of the invention will now be described by way of example and with reference to the accompanying diagrammatic drawings, in which:

FIGS. 4A, 4B & 4C show, in section, an assembly comprising the mandrel-gripping means, the rivet-feeding means, the mandrel-locating means and rivet-feeding means inhibiting means wherein FIG. 4A shows the gripping-means closed to grip a mandrel, FIG. 4B shows the gripping-means open to release the mandrel and FIG. 4C shows the gripping-means empty with no mandrel inserted;

DESCRIPTION OF THE PREFERRED EMBODIMENTS

Figure 1:
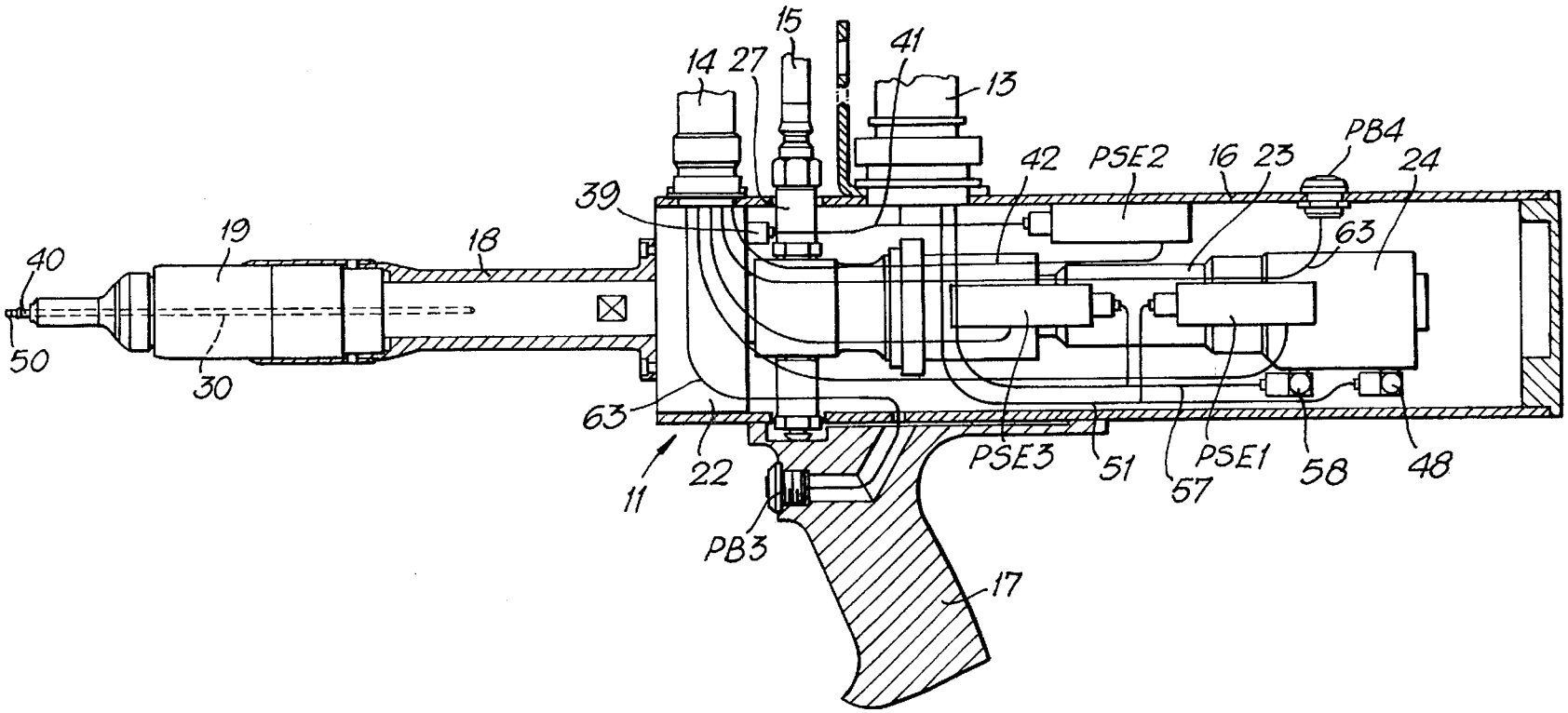
FIG. 1 shows a hand-held hydro-pneumatic rivet setting tool, the outer casing being shown in section, the inner assemblies being shown in outline, electrical leads being shown schematically in light lines and pneumatic conduits being shown schematically in heavy lines.

The riveting apparatus of this example comprises two main units, a hand-held riveting tool 11, and an equipment cabinet 12 to which it is connected by means of two multi-way flexible, namely a pneumatic multiway 13 and an electrical multi-way 14. The mandrel-retraction means within the tool is hydraulically operated and the tool is therefore also connected by means of a hydraulic hose 15 to a hydro-pneumatic intensifier 20, which is pneumatically actuated.

The hand-held tool 11 contains all the mechanical parts of the rivet placing apparatus, together with some parts of the hydraulic system and pneumatic and electrical control system; these are connected to the remainder of the control system, which is housed in the equipment cabinet 12, by the multiways 13 and 14.

The hand-held tool 11 has its various parts built into a housing which basically comprises a cylindrical body 16, a pistol grip 17, and a forwardly-projecting outer barrel 18. At the forward end of the barrel 18 is a mounted the nose-jaw assembly 19. Inside the tool there extends an inner fixed barrel 21 which is secured to the front end wall 22 of the body 16. On the outside of this inner barrel 21 is mounted a rear barrel 23, for limited reciprocation with respect to the inner barrel 21. On the rear end of the rear barrel 23 is mounted the mandrel-gripping device in the form of a tail-jaw assembly 24.

The front end of the rear barrel 23 is connected to an annular piston 25 which seals the rear end of an annular hydraulic slave cylinder space 26. This hydraulic slave cylinder 26 is connected via a hydraulic connector 27 to the hydraulic hose 15 and thence to the hydraulic intensifier 20. The piston and cylinder assembly 25, 26 provide power means for retracting the mandrel-gripping device.

Figure 3A:
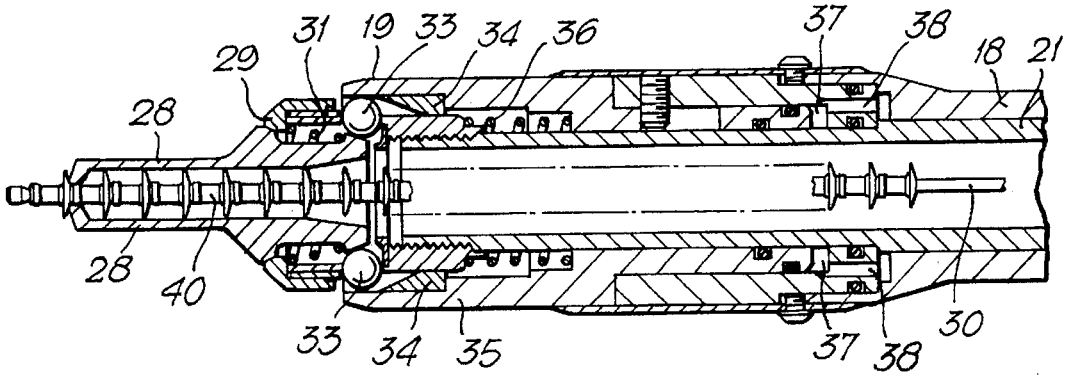
FIGS. 3A & 3B show the abutment nose jaws and the pneumatically powered abutment-opening means, with the nose-jaws in the closed and open positions respectively.

The nose jaw assembly 19 is mounted on the forward end of the inner barrel 21. Essentially it comprises two jaws 28, 28. The jaws are urged rearwardly into a holder 29 by a spring 31, and the shape of the holder and jaws is such that the rearward urging of the spring urges the front ends of the jaws together (FIG. 3A). When closed, the front end faces of the two jaws co-operate to provide an annular abutment or anvil 32. The jaws can be opened against the urging of the spring 31 by a leading rivet 40 pushed forwardly through them by the rivet feeding means.

In this example, power-operated opening means (P2.3 FIG. 5) for opening the jaws against the urging of spring 31 is provided. For each jaw 28 it comprises a ball 33 resting against the outer side of the rear end of the jaw, and a tapering cam 34 mounted in the jaw assembly housing 35 which can reciprocate to a limited extent.

Figure 3B:
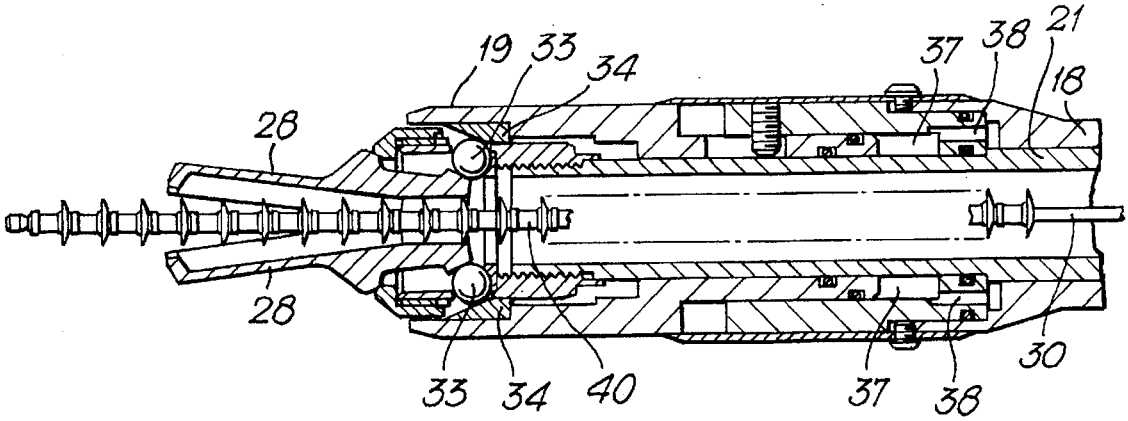

The jaw assembly housing 35 can be moved forwardly, against the urging of a spring 36, by means of pneumatic pressure applied to the annular space 37 behind it. Compressed air is fed to this space through bores 38. This pushes the cams 34 forwards, which push the balls 33 inwards, thus opening the jaws sufficiently wide apart to leave a good clearance for rivets on a mandrel, as illustrated in FIG. 3B. The bores 38 communicate through bores and conduits (not shown) with a pneumatic connector 39 on the back of the body front wall 22. This connector joins to an air line 41 running through the pneumatic multiway 13 to the equipment cabinet 12.

Means for detecting when the nose jaws are open is provided by an air-pressure sensor PSE2 connected into the nose jaw opening air line 41. When this detector indicates that sufficient air pressure is in line 41 to open the nose jaws 28, 28, the sensor closes an electrical switch and applies an electrical signal to electric connection 42 running through the electrical multiway 14 to the equipment cabinet.

Figure 5:
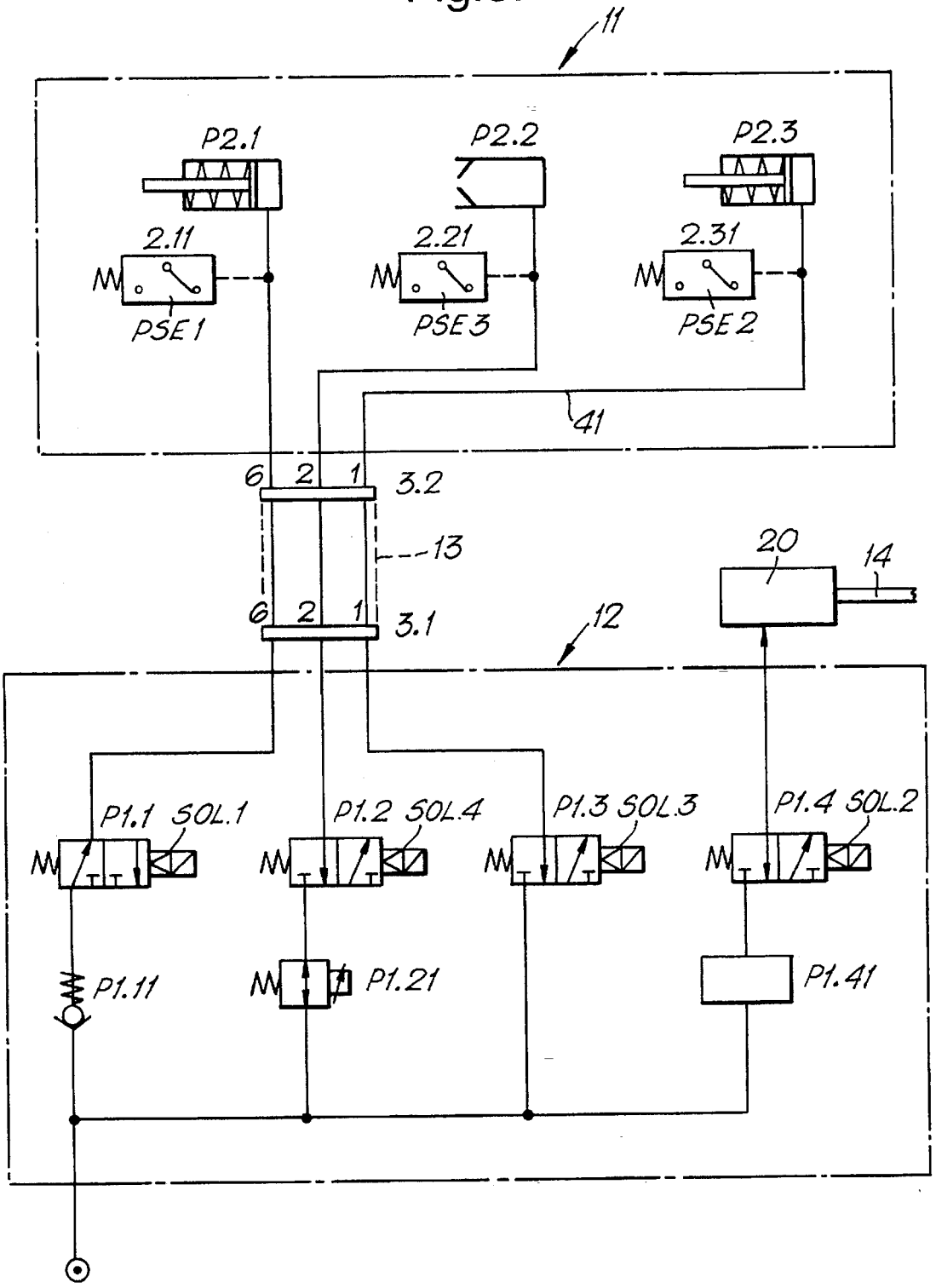
FIG. 5 shows schematically the pneumatic circuit diagram of the apparatus including its control system.
Figure 6A:
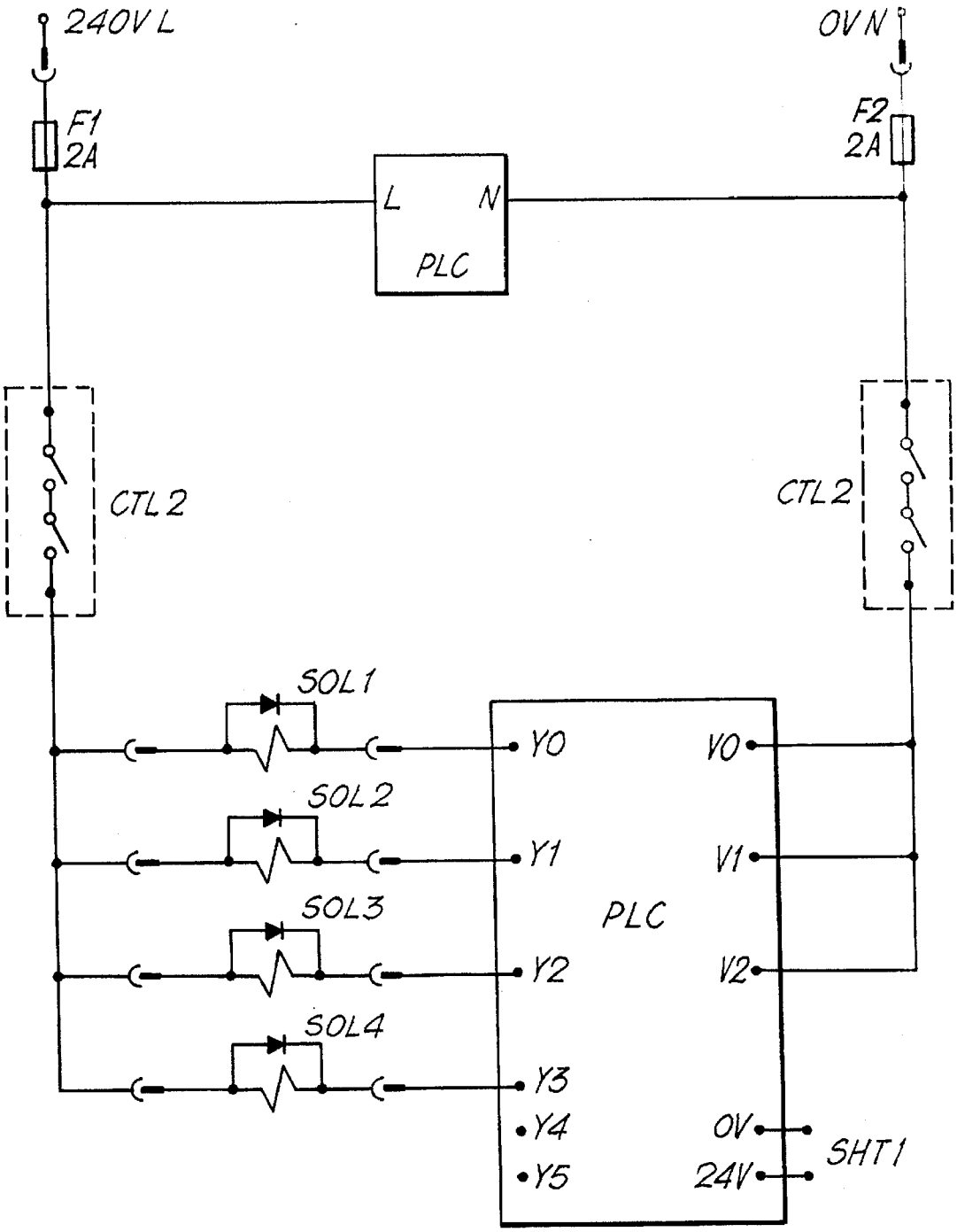
FIGS. 6A & 6B show schematically the electrical circuit diagram of the control system.

Means for controlling the supply of air to open and close the nose jaws is controlled by a solenoid-operated valve P1.3 (FIG. 5) which is actuated by solenoid SOL3 (FIGS. 5 & 6A). The solenoid SOL 3 is controlled by an electronic programmable logic controller PLC, which is programmed to control all of the functions of the riveting apparatus, in response to electrical input signals from various switches, comprising both detectors for checking the correct actuation of various pans of the apparatus, and manually operable switches for initiating various phases or modes of operation of the apparatus. Actuation of the solenoid SOL 3 is controlled by the programmable logic controller PLC in response to, amongst others, a manual push-button switch PB4.

The previously mentioned air pressure sensor PSE 2 is thus also connected to the controller PLC, which is programmed so that, unless the pressure detector PSE 2 detects that the nose jaws are un-actuated and therefore in the closed position (FIG. 3A), the controller PLC will not actuate solenoid SOL 2 (FIGS. 5 & 6A), which controls the pneumatic valve P1.4 which controls actuation of the pneumatic hydraulic intensifier 20. Thus rearward movement of the mandrel 30 is inhibited unless the nose jaws 28 are in the closed position.

Figure 2A:
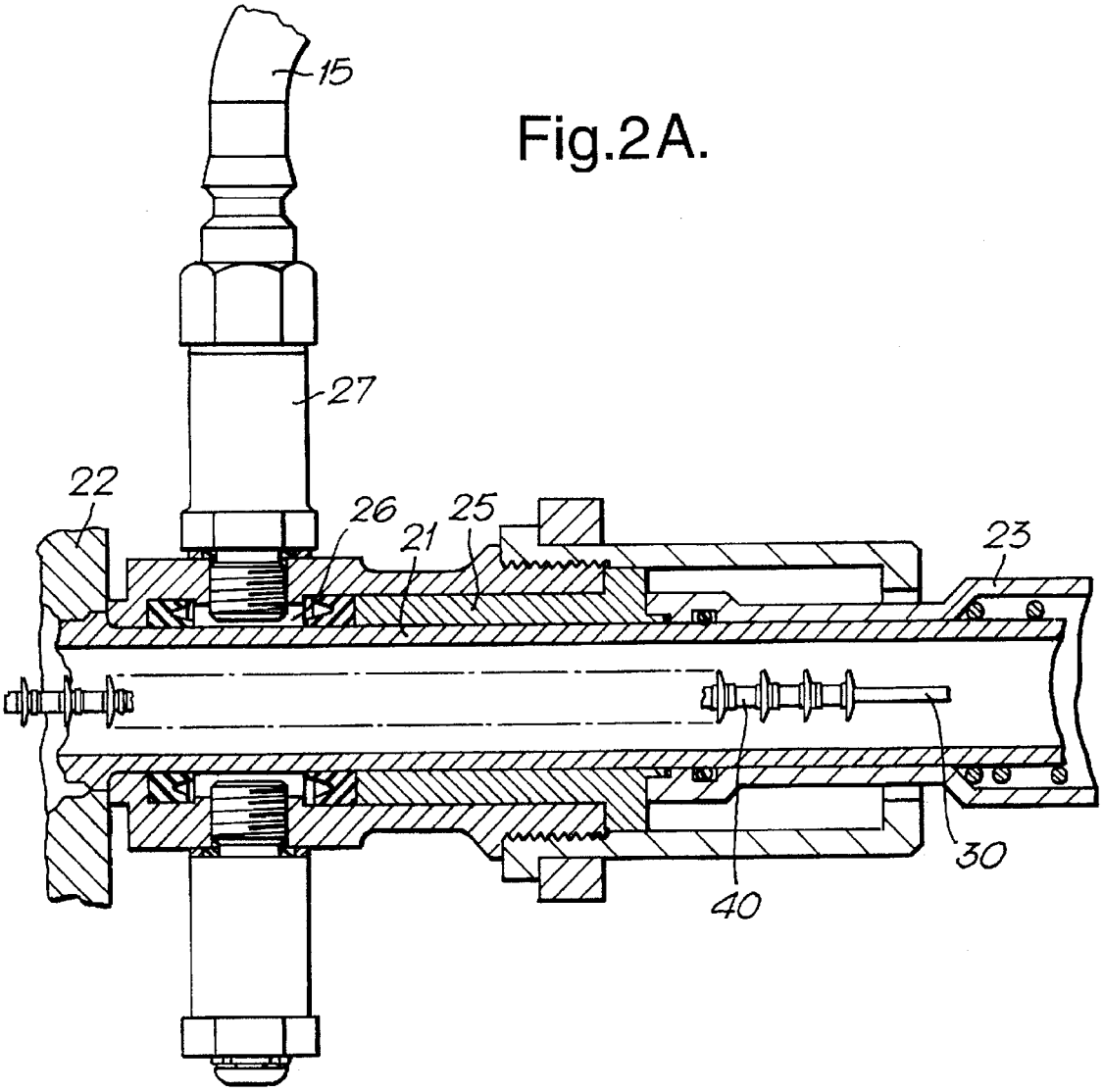
FIG. 2A & 2B show, in section, the hydraulic piston and cylinder arrangement for retracting the mandrel, in the forward and retracted positions respectively.
Figure 2B:
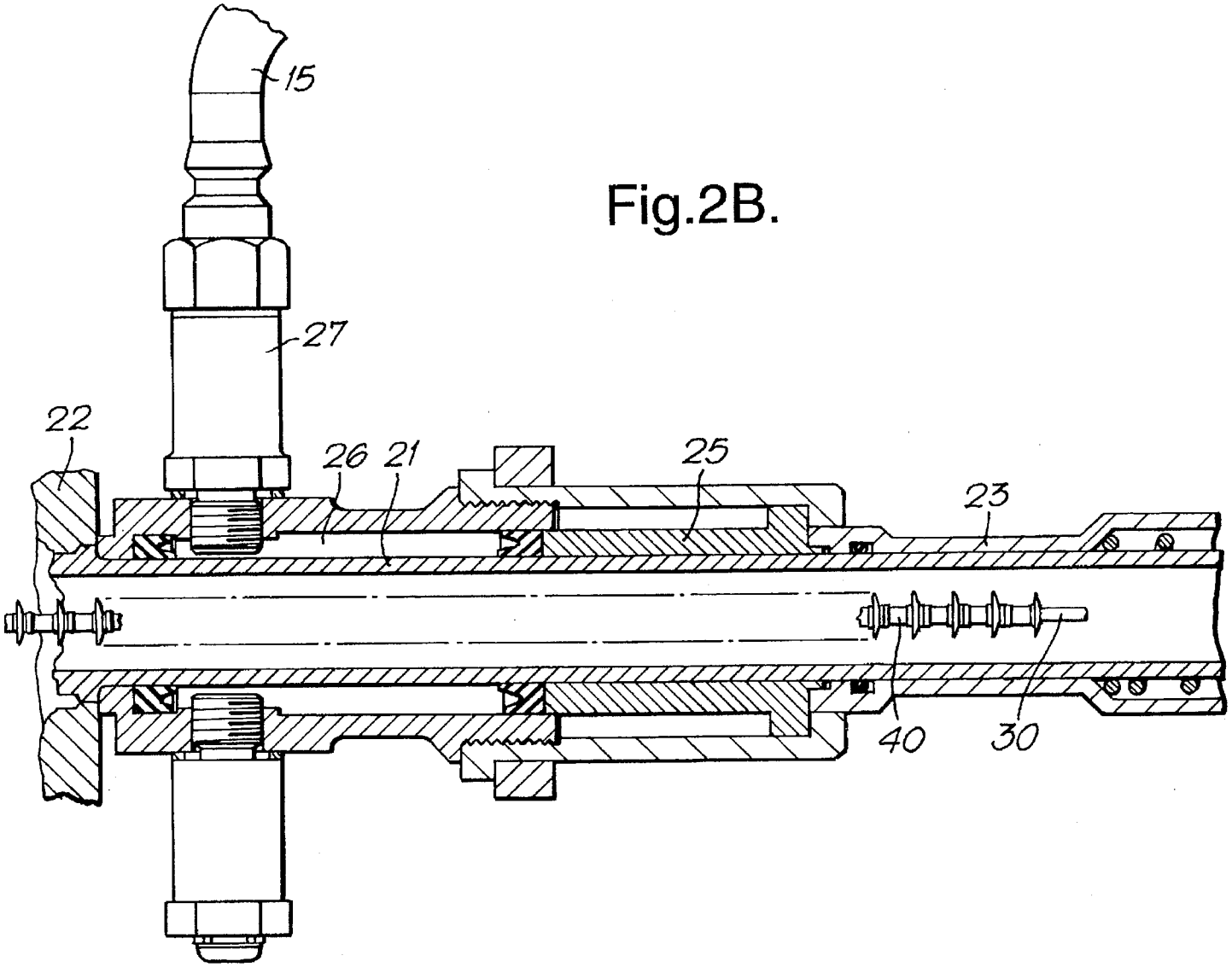
Figure 4A:
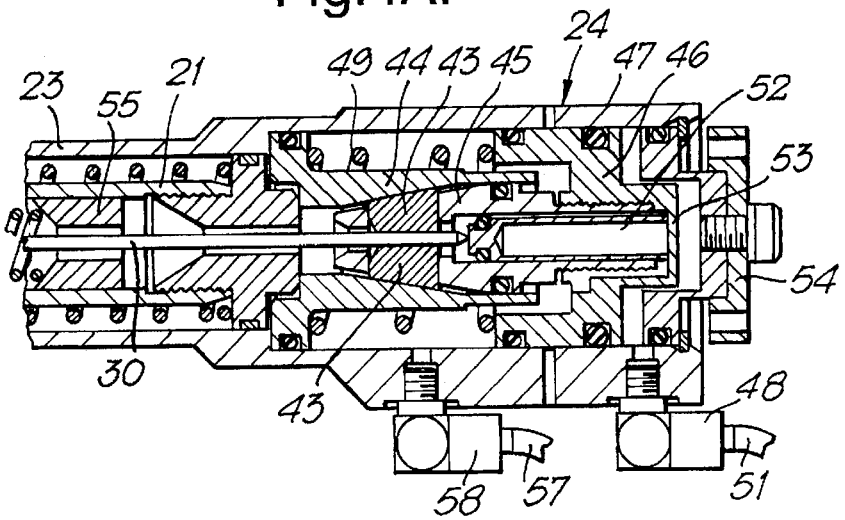
Figure 4B:
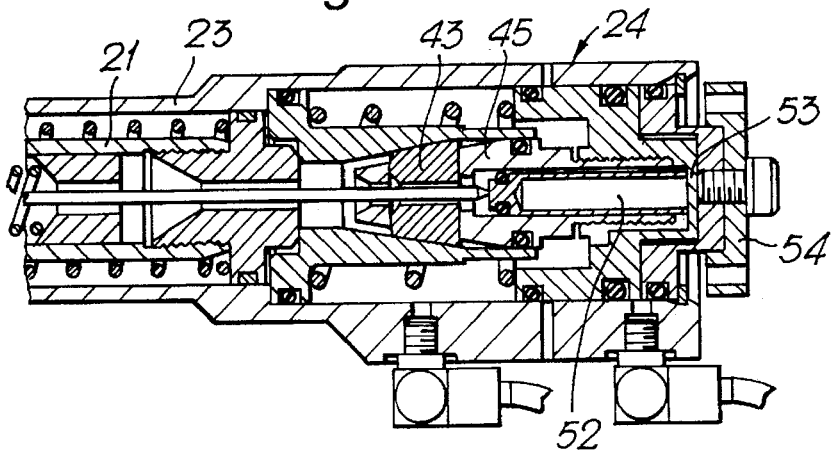

The mandrel gripping and retracting means as previously mentioned comprises the tail-jaw assembly 24 (FIGS. 4A, 4B & 4C) and the piston and cylinder assembly 25, 26 (FIGS. 2A & 2B). The tail jaw assembly 24, as is usual in this type of tool, comprises a pair of hardened steel tail jaws 43 carried in a jaw carrier 45, the outside faces of the jaws being tapered and co-operating with a tapered collet 44. The jaw carrier 44 is urged forwardly towards the mandrel 30 (i.e. to the left as viewed in FIG. 4A, 4B & 4C) by means of a tail jaw pneumatic closing device P2.1, comprising piston 46 sliding within a cylinder 47. When air pressure is applied to the rear of the piston 46 through a connector 48, to which tail jaw air line 51 is connected the jaw carrier 44 is urged forwardly to close the tail jaws 43 on to the mandrel 30 as previously described. When the air pressure is removed from the rear of the piston 46, a spring 49 urges the jaw carrier 44 rearwardly, thus releasing the tail jaws 43 from the mandrel.

Gripping detection means for detecting when the tail jaws are thus actuated into their mandrel gripping position is provided by a pressure sensor PSE 1, mounted inside the tool body 16 and connected to the tail jaw air line 51. Only when detector PSE 1 detects sufficient air pressure to keep the tail jaws gripping the mandrel, does it send an electrical signal to the controller PLC. If the controller PLC does not receive this signal, it will inhibit actuation of the hydraulic intensifier valve P.1.4 and thus inhibit retraction of the mandrel retraction means 25, 26.

The apparatus of this example is also provided with mandrel-locating means for axially locating a mandrel in the tool. The advantage of being able to do this is that it enables the head of the mandrel to be positioned accurately with respect to the nose jaw abutment, so that the space between the mandrel head 50 and the abutment can be appropriate to the length of the rivet to be set. If the space is too great, when the mandrel retracting means is actuated part of its stroke is wasted in bringing the mandrel head into contact with the rivet. Elimination of this waste of time and energy is advantageous.

In this example the mandrel locating means for locating the axial position of the rear or tail end of a mandrel of known pre-determined length comprises a movable stop member 52 (in the form of a piston which is largely hollow to save weight), in combination with a second stop member 53. The second stop member 53 is provided by the central portion of the rear end wall of the tail jaw closing piston 46. When the tail jaws 43 are open (FIG. 4B) to allow the insertion of a mandrel between them, the piston 46 is pushed backwards by the spring 49 so that it contacts a third stop member 54 which is fixed in position in relation to the nose jaw abutment when the mandrel retracting means is in its forward position in relation to the nose jaws abutment. The third stop member is provided by the rear wall of the tail jaw closing cylinder 47.

The third stop member 54 provides the rear end wall of the cylinder 47, and is held in place by a circlip 64. In order to discourage unauthorised access to the circlip, an end guard plate 65 is provided, secured to the member 54 by a screw 66. Initial loosening and removal of the securing screw 66 ensures safe relief of any air pressure within the cylinder 47 before the circlip 64 can be removed.

The tool of this example is also provided with pneumatically operated rivet feeding means P2.2, of the known type as described, for example, in GB 1 183 049. A piston 55 (FIG. 4A) which has a central bore through which the mandrel 30 extends, has in front of it a coil spring buffer 56 which contacts the rearmost rivet in the column of rivets on the mandrel. The piston is a sliding fit in the inner fixed panel 21. Air under pressure is supplied to the rear of the piston 55 by means of the rivet feed air line 57, a connector 58 on the rear jaw cylinder 47, and appropriate cut-outs and cavities in the parts inside the latter, as will be apparent from FIGS. 4A, 4B & 4C. In particular, the rivet feed air supply passes around and along the outside of the movable stop member 52, and then past the jaws 43.

Figure 4C:
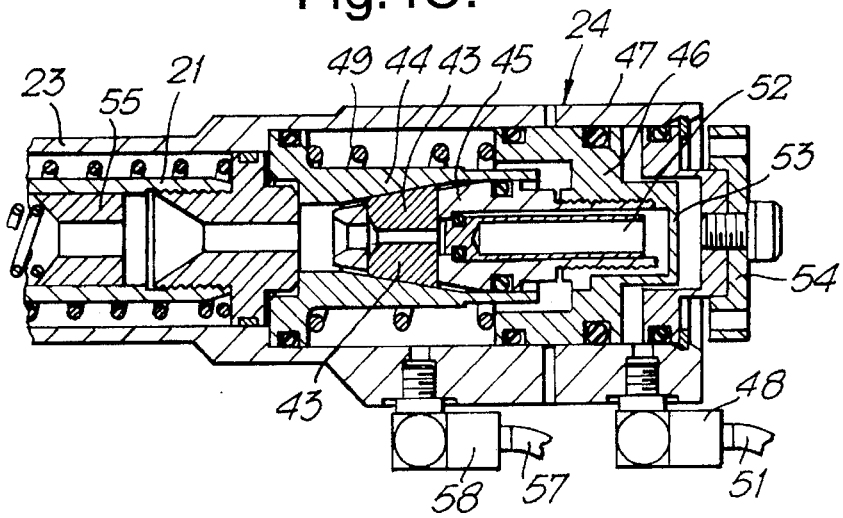

The front of the movable stop member 52 is provided with an annular O-ring seal 59 at its front end which co-operates with an annular shoulder 61 which provides a valve seal for the seal 59. The movable stop member 52 is urged forwardly by the rivet feed air pressure applied behind it. In the absence of a mandrel contacting the front of the stop member 52 and pushing it backwards, this air pressure urges the movable stop member 52 forwards so that the seal 59 contacts the seat 61. This prevents the passage of rivet feed pressure air forwards of the seat 61, towards the rivet feed piston 55 (as shown in FIG. 4C).

Thus, in the absence of a mandrel extending between the tail jaws 43 and rearwardly beyond them and pushing the movable stop member 52 rearwardly to open the valve 59, 61, air feed is shut off from the rivet feeding piston 55.

Supply of rivet feed air to rivet feed air line 57 is controlled by a valve P1.2 (FIG. 5) actuated by a solenoid SOL 4 (FIG. 5). The air line feeding air to the valve P1.2 for adjustment of the pressure of air applied to the rivet feeding means.

The riveting apparatus of this example is also provided with means for inhibiting operation of the apparatus if the pressure of air for operating the rivet feeding means does not lie within pre-determined limits. This takes the form of a rivet feed air pressure sensor PSE 3 (FIGS. 1 & 6B), mounted inside the tool body 16 and connected to the rivet feed air line 57. This sensor is also connected by means of an electrical line 62 to the controller PLC. While the sensor PSE 3 detects a rivet feed air pressure which lies between pre-determined limits (which are those within which the rivet feeding means will be satisfactorily operated) it sends an electrical signal to the controller PLC. As long as the controller PLC receives this signal, it allows the rivet setting apparatus to continue to operate (provided that no other inputs or lack of inputs leading to inhibition of operation are received). If the rivet feed air pressure goes outside the pre-determined limits, the sensor PSE 3 stops sending an electrical signal to the controller PLC. The controller PLC then actuates solenoid SOL 2 to shut the hydro-pneumatic intensifier valve P1.4 and prevent operation of the mandrel retracting piston 14.

Figure 6B:
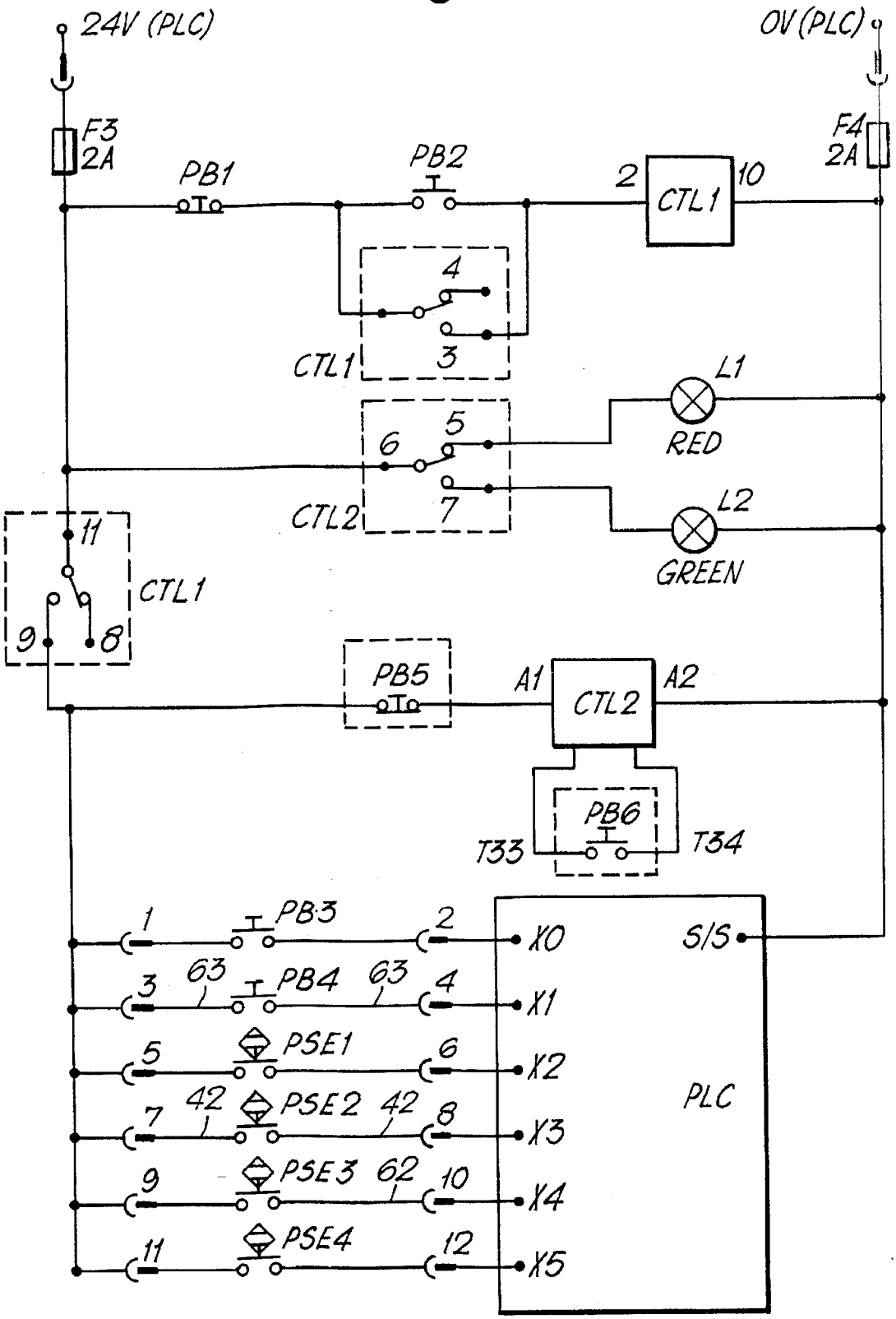

On previous hand-held rivet setting apparatus of the type defined, which is hydraulically powered and which include a remote pneumatic/hydraulic intensifier, of which the applicants are aware, the actuating trigger on the hand held tool has been a pneumatic valve connected to control the intensifier by means of a pneumatic signal line. However in the present example, the trigger switch is an electrical switch PB 3 (FIGS. 1 & 6B). It is connected by means of electrical signal line 63 to controller PLC. When the trigger is pressed, switch PB 3 closes, and the electrical signal sent along line 63 causes the controller PLC to actuate solenoid SOL 2 and thereby actuate the pneumatic/hydraulic intensifier 20, so that the mandrel retraction means is operated and a rivet is set. It should be noted that the controller PLC is programmed to actuate solenoid SOL 2 only provided that the various sensors, which monitor the condition of various parts of the placing apparatus as herein before described, indicate that the various parts of the placing apparatus, and the various air pressures, are appropriate to safe operation of the rivet setting tool.

The riveting apparatus of this example, including the control system provided by the controller PLC and its associated components, is arranged so that the riveting tool can be opened to allow removal of a mandrel (and any rivets which may remain on it) and its replacement by a mandrel loaded with rivets, and then closed again to grip the new mandrel, as quickly as possible. This assists in reducing the length of time of interruption of use of the apparatus due to the necessity to reload the tool.

In this example, a common actuation device, for actuating both the opening and the subsequent closing of the tool, is provided. Successive actuations of the actuation device by the operator alternately opens and closes the tool. The common actuation device is provided by an electrical push button switch PB 4 (FIGS. 1 & 6B). This switch is mounted on the upper part of the rear half of the tool cylindrical body 16, where it is convenient to be operated by the other hand of an operator who is holding the pistol grip 17 of the tool in one hand. Alternatively, the push button switch PB4 may be mounted at the top of the pistol grip 17, on either side, as is convenient, so that it can be operated by the same hand with which the operator holds the pistol grip. The switch PB 4 is connected by means of electrical lead 63 to the controller PLC. The controller PLC is arranged so that it controls the various parts of the tool appropriately, to open the tool if it is closed and holding a mandrel (the "unload" function) or to close the tool if it is open (the "load" function).

Thus, if the tool is holding a mandrel which contains insufficient rivets and the operator needs to unload the tool, the operator presses the switch PB 4 and the controller PLC causes the following actions to occur in sequence:

1. solenoid SOL 4 is de-activated, thus closing pneumatic valve P1.2 and thus switching off the rivet feeding air supply;
2. a time delay of about 0.5 seconds occurs;
3. solenoid SOL 3 is activated, thus opening pneumatic valve P1.3, supplying air feed to the nose jaw actuator P2.3 so that the nose jaws open;
4. solenoid SOL 1 is activated, thus closing pneumatic valve P1.1 and de-activating the tail jaw gripping actuating device P2.1, so that the tail jaws open and release the tail end of the mandrel.

The operator can then grasp the head end of the mandrel and remove it, together with any rivets remaining on it which easily pass through the open nose jaws 28, 28. The operator inserts a fully loaded mandrel, tail end first, through the open nose jaws, until its tail end enters the open tail jaws 43, 43, contacts the movable stop member 52 and pushes it back against the rear end wall 53 as previously described. The operator then presses the switch PB 4 again. The controller PLC causes the following actions to occur in sequence:

1. solenoid SOL 1 is de-activated, thus closing valve P1.1 and activating the tail jaw gripping actuating device P2.1, so that the tail jaws close and slip the tail end of the mandrel;
2. a time delay of about 0.2 seconds occurs;
3. solenoid SOL 4 is activated, thus opening pneumatic valve P1.2, and thus switching on the rivet feed air supply;
4. a time delay of about 0.5 seconds occurs;
5. solenoid SOL 3 is de-activated, thus closing pneumatic valve P1.3 shutting-off air feed to the nose jaw actuator P2.3 so that the nose jaws close.

The rivet setting tool is then ready for use again. It is believed that, using the system described, a trained operator can open the tool, remove a mandrel and replace it by a new loaded mandrel, close the tool and be ready for riveting again, in a time of as little as six seconds.

The riveting apparatus of this example is also provided with a "switch-on" push button switch PB 2 and a "switch-off" push button switch PB 1, for use when the whole system is switched on and off at the start and finish of operation. Thus actuation of the "on" switch PB 2 actuates the controller PLC to cause to happen, in sequence:- closure of the tail jaws 43, 43; a time delay of about 0.5 seconds; closure of the nose jaws 28, 28;and operation of the rivet feeding device P2.2.

Similarly, actuation of the "off" switch PB 1 actuates the controller PLC to cause to happen, in sequence, closure of the tail jaws 43, 43 (if at the time they are not already closed); closure of the nose jaws 28, 28 (if at the time they are not already closed); and de-activation of the rivet feed device P2.2.

Thus the "off" switch may be actuated when the tool is either loaded (i.e. containing a mandrel) or unloaded (i.e. not containing a mandrel).

The system of this example is also provided with "emergency stop" push button switch PB 5. Actuation of this switch causes the apparatus to stop immediately, but with the tail jaws still gripping the mandrel. An "emergency stop reset" push button switch PB 6 is also provided, actuation of which resets the system for continued operation.

As mentioned previously, FIG. 5 is a schematic circuit diagram of the pneumatic circuitry of the apparatus. FIGS. 6A & 6B are schematic circuit diagrams of the electrical circuitry of the apparatus, FIGS. 6A showing the circuits associated with the output side of the controller PLC, and FIG. 6B showing the circuitry associated with the input side of the controller.

The various reference symbols and the circuit elements they refer to are as follows:

| SYMBOL | DESCRIPTION |
|---|---|
| PNEUMATIC CIRCUITS | |
| P1.1 | TAIL JAW VALVE (NORMALLY OPEN) |
| P1.2 | AIR CURSOR VALVE (NORMALLY CLOSED) |
| P1.3 | NOSE JAW VALVE (NORMALLY CLOSED) |
| P1.4 | INTENSIFIER VALVE (NORMALLY CLOSED) |
| P1.11 | NON RETURN VALVE |
| P1.21 | AIR CURSOR REGULATOR |
| P1.41 | 724 INTENSIFIER VALVE |
| P2.1 | TAIL JAWS |
| P2.2 | AIR CURSOR |
| P2.3 | NOSE JAW |
| P2.11 | TAIL JAW PRESSURE SENSOR |
| P2.21 | AIR CURSOR PRESSURE SENSOR |
| P2.31 | NOSE JAW PRESSURE SENSOR |
| P3.1 | MULTI CONNECTOR |
| P3.2 | MULTI CONNECTOR |
| ELECTRICAL CIRCUITS | |
| PLC | PROGRAMMABLE LOGIC CONTROLLER |
| CTL1 | CONTROL RELAY |
| CTL2 | CONTROL RELAY (PNOZ5) |
| F1 TO F4 | FUSES |
| L1 TO L2 | LAMPS |
| PB1 | CONTROL OFF |
| PB2 | CONTROL ON |
| PB3 | TRIGGER |
| PB4 | LOAD/UNLOAD |
| PB5 | EMERGENCY STOP |
| PB6 | EMERGENCY/STOP RESET CONTROL |
| SOL1 | TAIL JAW SOLENOID |
| SOL2 | INTENSIFIER SOLENOID |
| SOL3 | NOSE JAW SOLENOID |
| SOL4 | AIR CURSOR SOLENOID |
| PSE1 | TAIL JAW PRESSURE SENSOR |
| PSE2 | NOSE JAW PRESSURE SENSOR |
| PSE3 | RIVET FEEDING PRESSURE SENSOR |
| PSE4 | RIVET FEEDING PRESSURE SENSOR (MAX LIMIT) |

The various reference symbols used for mechanical parts of the system are as follows:

| MECHANICAL PARTS LIST | | | |
|---|---|---|---|
| | | 40 | RIVET |
| 11 | HAND HELD TOOL | 41 | NOSE JAW AIR LINE |
| 12 | EQUIPMENT CABINET | 42 | NOSE JAW ELECTRIC SIGNAL CONNECTION |
| 13 | PNEUMATIC MULTIWAY | 43 | TAIL JAWS |
| 14 | ELECTRICAL MULTIWAY | 44 | TAIL JAW COLLET |
| 15 | HYDRAULIC HOSE | 45 | TAIL JAW CARRIER |
| 16 | TOOL CYLINDRICAL BODY | 46 | TAIL JAW CLOSING |

-continued

| MECHANICAL PARTS LIST | | | |
|---|---|---|---|
| | | | PISTON |
| 17 | PISTOL GRIP | 47 | TAIL JAW CLOSING |
| 18 | FORWARD OUTER BARREL | 48 | TAIL JAW AIR CONNECTOR |
| 19 | NOSE JAW ASSEMBLY | 49 | TAIL JAW RELEASE SPRING |
| 20 | HYDRAULIC INTENSIFIER | 50 | MANDREL HEAD |
| 21 | INNER FIXED BARREL | 51 | TAIL JAW AIR LINE |
| 22 | FRONT WALL OF BODY | 52 | MOVABLE STOP MEMBER |
| 23 | REAR BARREL | 53 | SECOND STOP MEMBER |
| 24 | TAIL JAW ASSEMBLY | 54 | THIRD STOP MEMBER |
| 25 | ANNULAR PISTON | 55 | RIVET FEED PISTON |
| 26 | HYDRAULIC SLAVE CYLINDER | 56 | RIVET FEED SPRING BUFFER |
| 27 | HYDRAULIC CONNECTOR | 57 | RIVET FEED AIR LINE |
| 28 | NOSE JAWS | 58 | RIVET FEED AIR CONNECTOR |
| 29 | JAW HOLDER | 59 | O-RING SEAL ON 52 |
| 30 | MANDREL | | |
| 31 | NOSE JAW SPRING | 61 | ANNULAR SHOULDER SEAT FOR 59 |
| 32 | ANNULAR ANVIL | 62 | RIVET FEED PRESSURE ELECTRIC LINE |
| 33 | JAW OPENING BALL | 63 | TRIGGER ELECTRIC LINE |
| 34 | TAPERING CAM | 64 | CIRCLIP |
| 35 | JAW ASSEMBLY HOUSING | 65 | END GUARD PLATE |
| 36 | JAW ASSY, SPRING | 66 | SECURING SCREW |
| 37 | JAW OPENING ANNULAR SPACE | 67 | ADJUSTABLE STOP PIN |
| 38 | JAW OPENING FEED BORES | 68 | REAR END CAP |
| 39 | NOSE JAW PNEUMATIC CONNECTOR | 69 | THREADED ENGAGEMENT |
| | | 71 | HEXAGONAL RECESS |

Figure 4D:
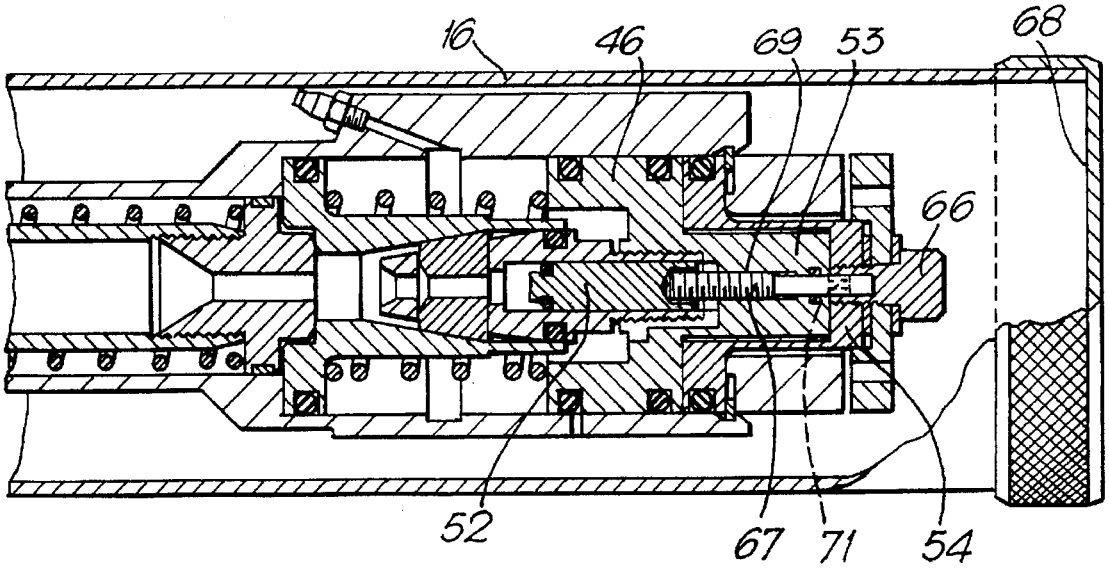
FIG. 4D is similar to FIG. 4C but shows a modified form of mandrel locating means.

FIG. 4D illustrates a modified form of mandrel-locating means which is adjustable. The second stop member 53 incorporates an adjustable stop pin 67 which projects forwardly towards the movable stop 52, so that the rear end of the movable stop 52 contacts the front end of the pin 67. The pin 67 is in threaded engagement at 69 with the second stop member 53, so that the axial position of the pin 67, with respect to the stop member 53, can be adjusted. Rotation of the pin 67 with respect to the stop member 53 is achieved by removing the rear end cap 68 of the tool, and unscrewing the securing screw 66. This allows access to the rear end of the pin 67, which is provided with a hexagonal recess 71, so that the pin 67 can be rotated by means of a hexagonal key to adjust its longitudinal portion. In order to prevent rotation of the stop member 53 when this adjustment is made, the cross-sectional shapes of the outside of the rear part of the stop member 53, and of the inside of the third stop member 54 within which it is received, are made non-circular, e.g. square.

The adjustable locating means for the mandrel allows a mandrel of one predetermined length to be used with rivets of different lengths on different production runs, a total adjustment distance of 6 millimetres being available at the adjustable pin 67. In use, a mandrel is inserted into the tool until it contacts the adjustable stop 52. The nose jaws are then closed with a sample rivet between the mandrel head and the anvil abutment. The stop 67 is adjusted while the mandrel is kept in contact with the first stop member 53, until the length of the rivet just fills the space between the mandrel head and the anvil.

Alternatively, or additionally, of course, this adjustment allows the use of a mandrel of a slightly different length to be used.

The invention is not restricted to the details of the foregoing example. For instance, the various power-operated means could be operated electrically (e.g. by using solenoids), or hydraulically, instead of being operated pneumatically.

It would be possible additionally to include positive sensors in the control system, to positively ensure that various mechanical elements of the apparatus are in the correct positions, before the control system allows continued operation of the apparatus.

The air pressure sensors for the rivet-feeding means and the nose jaws operating means could be housed in the control equipment cabinet, thereby allowing the tool riveting head to be smaller and lighter.

We claim:

1. A riveting apparatus, which comprises:

an abutment;

an elongated mandrel, having a head at one end and loaded with a plurality of tubular rivets forming a column of rivets on the mandrel;

a gripping mechanism gripping said mandrel, said gripping mechanism being located in proximity with an end of said mandrel remote from the head;

a mechanism reciprocating said mandrel relative to said abutment by relative reciprocation between the gripping mechanism and the abutment such that the rivets in the column are fed forwardly along the mandrel so that a leading rivet nearest the mandrel head is positionable between the mandrel head and the abutment and is settable by moving the mandrel rearwardly relative to the abutment so as to draw the head of the mandrel through the bore of the rivet while the rivet is supported by the abutment;

a mechanism feeding the rivets forwardly along the mandrel, said abutment comprising a plurality of members movable between a closed position to form said abutment and to support a rivet and an open position to allow free passage of rivets therebetween; and a control system including an actuation device, such that, upon actuation by an operator of the actuation device when the riveting apparatus has said mandrel located therein, the control system controls the riveting apparatus, wherein said control system comprises:

a mechanism deactivating the rivet-feeding means a mechanism opening the abutment member and a mechanism deactivating the gripping mechanism so that the mandrel and any rivets remaining thereon are readily removable from the apparatus.

2. Riveting apparatus as claimed in claim 1, wherein said mechanism deactivating the rivet-feeding mechanism includes a mechanism generating a time delay after-deactivation of the rivet feeding mechanism and before the opening of the abutment members.

3. Riveting apparatus as claimed in claim 2, wherein which the time delay is about 0.5 seconds.

4. A riveting apparatus, which comprises:

an abutment;

an elongated mandrel, having an head at one end and loaded with a plurality of tubular rivets forming a column of rivets on the mandrel;

a gripping mechanism gripping said mandrel, said gripping mechanism being located in proximity with an end of said mandrel remote from the head;

a mechanism reciprocating said mandrel relative to said abutment by relative reciprocation between the gripping mechanism and the abutment such that the rivets in the column are fed forwardly along the mandrel so that a leading rivet nearest the mandrel head is positionable between the mandrel head and the abutment and is settable by moving the mandrel rearwardly relative to the abutment so as to draw the head of the mandrel through the bore of the rivet while the rivet is supported by the abutment;

a mechanism feeding the rivets forwardly along the mandrel, said abutment comprising a plurality of members movable between a closed position to form said abutment and to support a rivet and an open position to allow free passage of rivets therebetween; and a control system including an actuation device, such that, upon actuation by an operator of the actuation device when the riveting apparatus has said mandrel located therein, the control system controls the riveting apparatus, wherein said control system comprises:

a mechanism activating the mandrel-gripping mechanism;

a mechanism activating the rivet-feeding mechanism;

and a mechanism closing the abutment members so as to prepare the apparatus for further setting of rivets.

5. Riveting apparatus as claimed in claim 4, which comprises a mechanism generating a time delay before activation of the rivet feeding mechanism.

6. Riveting apparatus as claimed in claim 5, wherein which the time delay is about 0.2 seconds.

7. Riveting apparatus as claimed in claim 4 which comprises a mechanism generating a time delay after activation of the rivet feeding mechanism and before the closing of the abutment members by the closing mechanism.

8. Riveting apparatus as claimed in claim 7, wherein which the time delay is about 0.5 seconds.

9. Riveting apparatus as claimed in claims 1 or 4, in which the actuation device comprises an electrical switch.

10. Riveting apparatus as claimed in claims 1 or 4, which comprises a mechanism resiliently urging the abutment members towards a closed position so as to provide support of a rivet during setting, the members being forced apart against the resilient urging by a rivet being fed forwardly between them, and also including power-operated opening mechanism opening the members against the resilient urging mechanism, independently of the feeding of a rivet between the members, to facilitate removal of a first mandrel from the apparatus and insertion of a second mandrel, loaded with rivets, into the apparatus.

11. Riveting apparatus as claimed in claim 10, which comprises a power supply mechanism supplying power to the power-operated opening mechanism;

a power-control mechanism controlling the supply of power by the power supply mechanism to the opening mechanism; and an actuating mechanism actuating the power-control mechanism to supply and shut-off power to the opening mechanism as required.

12. Riveting apparatus as claimed in claim 11, in which the opening mechanism is operated by pneumatic power; the power-control mechanism comprises an electrically-controlled air valve; and the actuating mechanism comprises an electrical switch.

13. Riveting apparatus as claimed in claim 10, in which the opening mechanism is operated by pneumatic power.

14. Riveting apparatus as claimed in claim 10, also including an abutment condition detection mechanism detecting whether the abutment members are in the closed position or not.

15. Riveting apparatus as claimed in claim 14, which comprises a mandrel movement inhibiting mechanism operatively connected to the abutment condition detection mechanism and inhibiting rearward movement of the mandrel relative to the abutment unless the abutment members are in the closed position.

16. Riveting apparatus as claimed in claim 1, wherein said actuation device actuates each of said deactivating mechanisms and said opening mechanism.

17. Riveting apparatus as claimed in claim 4, wherein said actuation device actuates each of said activating mechanisms and said closing mechanism.

* * * * *